US011139092B2

(12) United States Patent
Kim et al.

(10) Patent No.: US 11,139,092 B2
(45) Date of Patent: Oct. 5, 2021

(54) RESISTOR COMPONENT

(71) Applicant: SAMSUNG ELECTRO-MECHANICS CO., LTD., Suwon-si (KR)

(72) Inventors: Hyung Min Kim, Suwon-si (KR); Su Rim Bae, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 16/864,582

(22) Filed: May 1, 2020

(65) Prior Publication Data

US 2021/0193353 A1 Jun. 24, 2021

(30) Foreign Application Priority Data

Dec. 23, 2019 (KR) ..... 10-2019-0172618

(51) Int. Cl.

| | |
|---|---|
| ***H01C 7/00*** | (2006.01) |
| ***H01C 17/065*** | (2006.01) |
| ***H01C 1/01*** | (2006.01) |
| ***H01C 1/14*** | (2006.01) |

(52) U.S. Cl.

CPC ..... *H01C 7/003* (2013.01); *H01C 1/01* (2013.01); *H01C 1/14* (2013.01); *H01C 17/065* (2013.01)

(58) Field of Classification Search

CPC . H01C 7/003; H01C 1/01; H01C 1/14; H01C 17/065

See application file for complete search history.

(56) References Cited

U.S. PATENT DOCUMENTS

| | | | | |
|---|---|---|---|---|
| 2,282,398 | A * | 5/1942 | Ehrlich | H01C 1/032 156/162 |
| 8,310,334 | B2 * | 11/2012 | Chen | H01C 7/003 338/262 |
| 9,373,430 | B2 * | 6/2016 | Wei | H01C 1/148 |
| 9,928,947 | B1 * | 3/2018 | Lee | H01C 1/148 |
| 10,312,317 | B2 * | 6/2019 | Yoo | H01C 1/142 |
| 2010/0225439 | A1 * | 9/2010 | Han | H01C 1/012 338/309 |
| 2012/0006583 | A1 * | 1/2012 | Ishihara | H01T 4/02 174/254 |
| 2014/0292474 | A1 * | 10/2014 | Ryu | H01C 1/14 338/306 |
| 2016/0372242 | A1 * | 12/2016 | Lee | H01C 1/028 |
| 2018/0061533 | A1 * | 3/2018 | Park | H01C 7/003 |

FOREIGN PATENT DOCUMENTS

| | | | |
|---|---|---|---|
| JP | 2019192759 | A | 10/2019 |
| KR | 10-2017-0073400 | A | 6/2017 |

* cited by examiner

*Primary Examiner* — Kyung S Lee

(74) *Attorney, Agent, or Firm* — Morgan, Lewis & Bockius LLP

(57) ABSTRACT

A resistor component includes an insulating substrate; a resistance layer disposed on a first surface of the insulating layer; and first and second terminals, spaced apart from each other, disposed on an external surface of the insulating substrate and connected to the resistance layer; a marking pattern portion disposed on a second surface of the insulating layer, opposing the first surface of the insulating substrate; and a marking protection layer disposed on the second surface and covering the marking pattern portion.

20 Claims, 7 Drawing Sheets

RESISTOR COMPONENT

CROSS-REFERENCE TO RELATED APPLICATION(S)

The present application claims the benefit of priority to Korean Patent Application No. 10-2019-0172618, filed on Dec. 23, 2019 in the Korean Intellectual Property Office, the disclosure of which is incorporated herein by reference in its entirety.

TECHNICAL FIELD

The present disclosure relates to a resistor component.

BACKGROUND

A resistor component is a passive electronic component used to implement a precise degree of resistance and serves to adjust a current and drop a voltage in an electronic circuit.

As electronic devices have recently been miniaturized and refined, the size of the electronic circuits employed in electronic devices has also gradually been miniaturized. Accordingly, the size of the resistor element has also gradually been miniaturized.

Meanwhile, an identification mark may be provided on a resistor component for the purpose of conveying information of the component, which may be damaged in subsequent processes.

SUMMARY

An aspect of the present disclosure may provide a resistor component capable of having reduced defects such as a damage to a marking pattern portion.

According to an aspect of the present disclosure, a resistor component includes an insulating substrate; a resistance layer disposed on a first surface of the insulating layer; and first and second terminals, spaced apart from each other, disposed on external surfaces of the insulating substrate and connected to the resistance layer; a marking pattern portion disposed on a second surface of the insulating layer, opposing the first surface of the insulating substrate; and a marking protection layer disposed on the second surface and covering the marking pattern portion.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
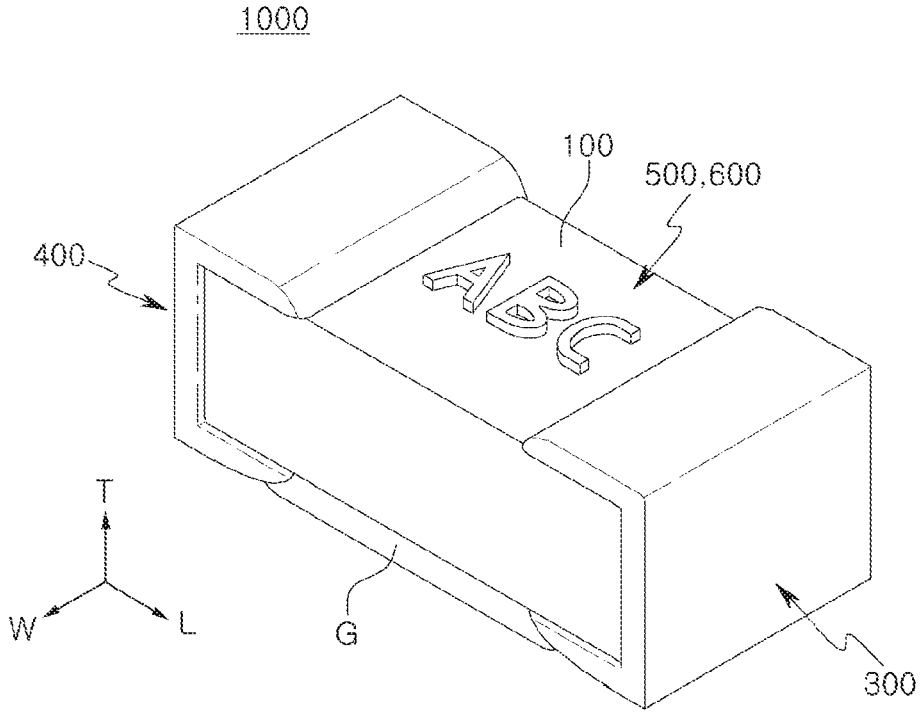
FIG. 1 is a schematic diagram illustrating a resistor component according to an exemplary embodiment of the present disclosure.

Hereinbelow, terms referring to the elements of the present disclosure are named in consideration of the functions of the respective elements, and thus should not be understood as limiting the technical elements of the present disclosure. As used herein, singular forms may include plural forms as well unless the context explicitly indicates otherwise. Further, as used herein, the terms "include", "have", and their conjugates denote a certain feature, numeral, step, operation, element, component, or a combination thereof, and should not be construed to exclude the existence of or a possibility of addition of one or more other features, numerals, steps, operations, elements, components, or combinations thereof. In addition, it will be the term "on" does not necessarily mean that any element is positioned on an upper side based on a gravity direction, but means that any element is positioned above or below a target portion.

Throughout the specification, it will be understood that when an element or layer is referred to as being "connected to" or "coupled to" another element or layer, it can be understood as being "directly connected" or "directly coupled" to the other element or layer or intervening elements or layers may be present. It will be further understood that the terms "comprises," "comprising," "includes," and/or "including" specify the presence of elements, but do not preclude the presence or addition of one or more other elements.

The size and thickness of each component illustrated in the drawings are represented for convenience of explanation, and the present disclosure is not necessarily limited thereto.

In the drawings, the expression "W direction" may refer to "first direction" or "width direction," and the expression "L direction" may refer to "second direction" or "length direction" while the expression "T direction" may refer to "third direction" or "thickness direction."

A value used to describe a parameter such as a 1-D dimension of an element including, but not limited to, "length," "width," "thickness," diameter," "distance," "gap," and/or "size," a 2-D dimension of an element including, but not limited to, "area" and/or "size," a 3-D dimension of an element including, but not limited to, "volume" and/or "size", and a property of an element including, not limited to, "roughness," "density," "weight," "weight ratio," and/or "molar ratio" may be obtained by the method(s) and/or the tool(s) described in the present disclosure. The present disclosure, however, is not limited thereto. Other methods and/or tools appreciated by one of ordinary skill in the art, even if not described in the present disclosure, may also be used.

Hereinafter, a resistor component according to the exemplary embodiments of the present disclosure will now be described in detail with reference to the accompanying drawings. The same or corresponding components were given the same reference signs and will not explained further.

Figure 2:
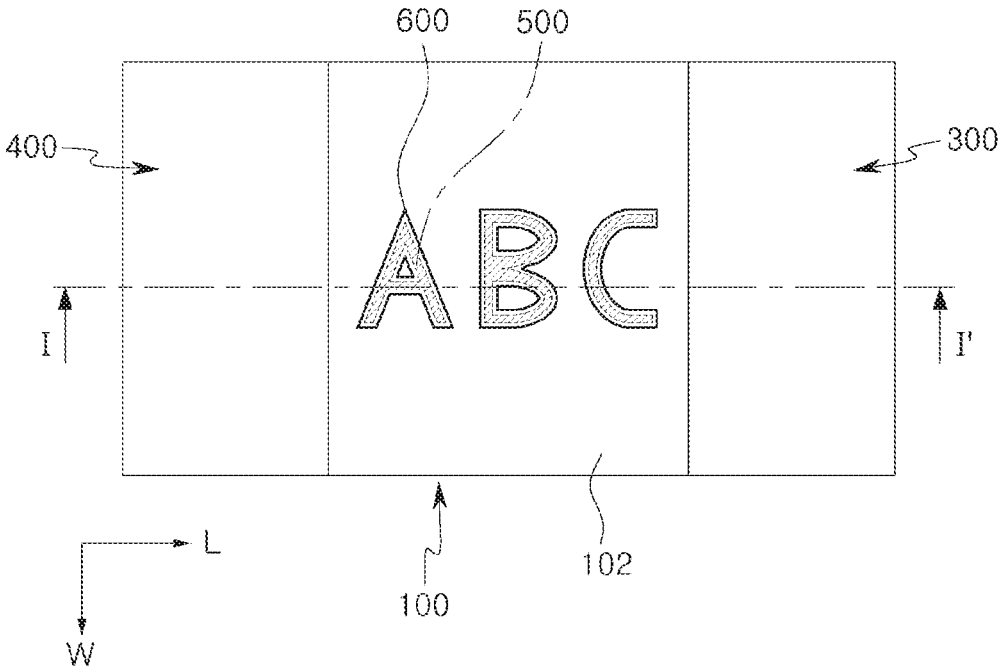
FIG. 2 is a top view schematically illustrating FIG. 1.
Figure 3:
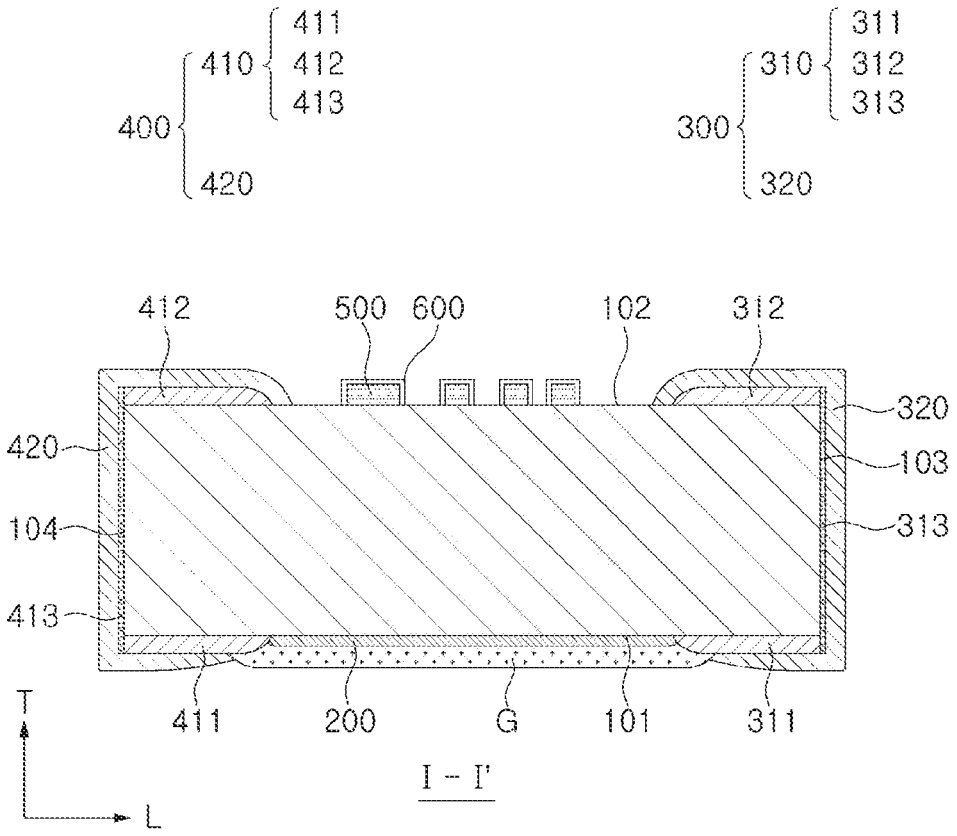
FIG. 3 is a schematic diagram illustrating a cross-section taken along line I-I' of FIG. 1.
Figure 4:
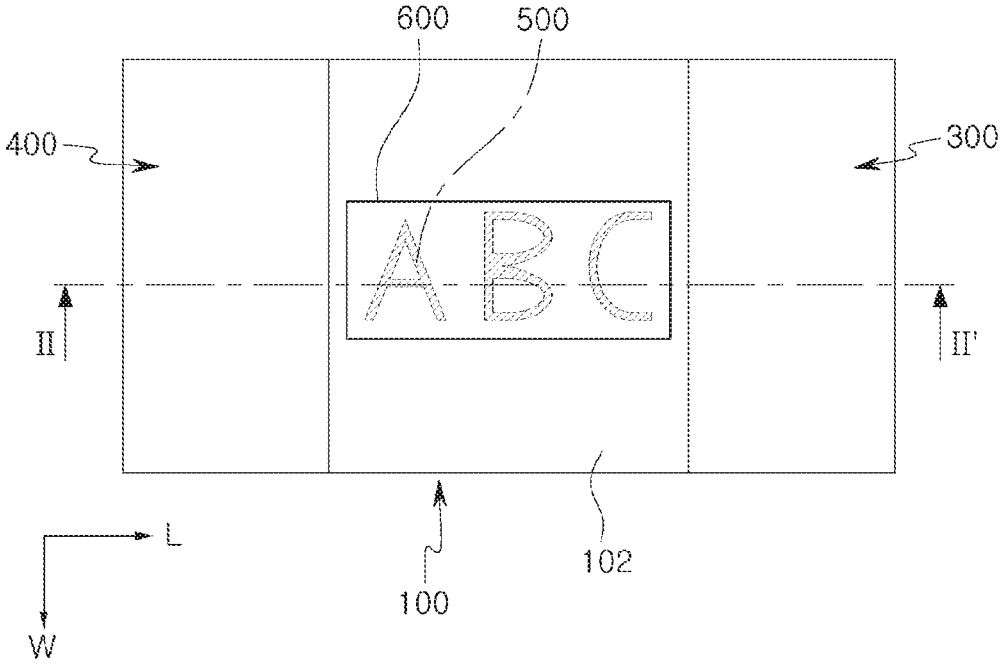
FIG. 4 is a diagram schematically illustrating a modified example of a resistor component according to an exemplary embodiment and corresponding to FIG. 2.
Figure 5:
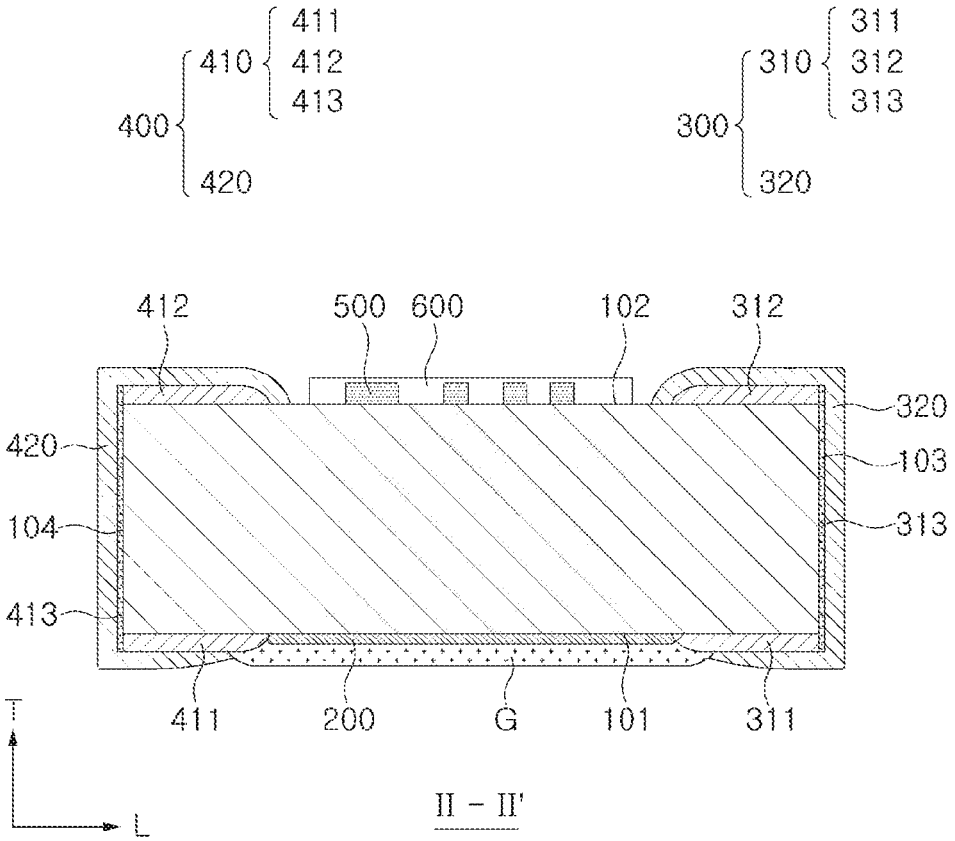
FIG. 5 is a schematic diagram illustrating a cross-section taken along line II-II' of FIG. 4.
Figure 6:
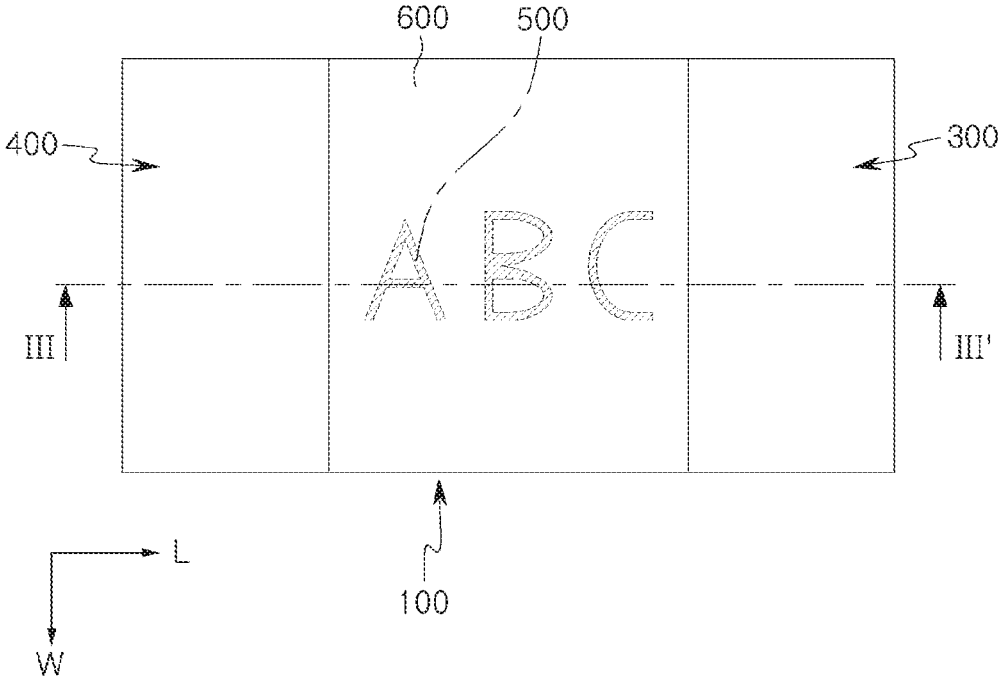
FIG. 6 is a diagram schematically illustrating another modified example of a resistor component according to an exemplary embodiment and corresponding to FIG. 2.
Figure 7:
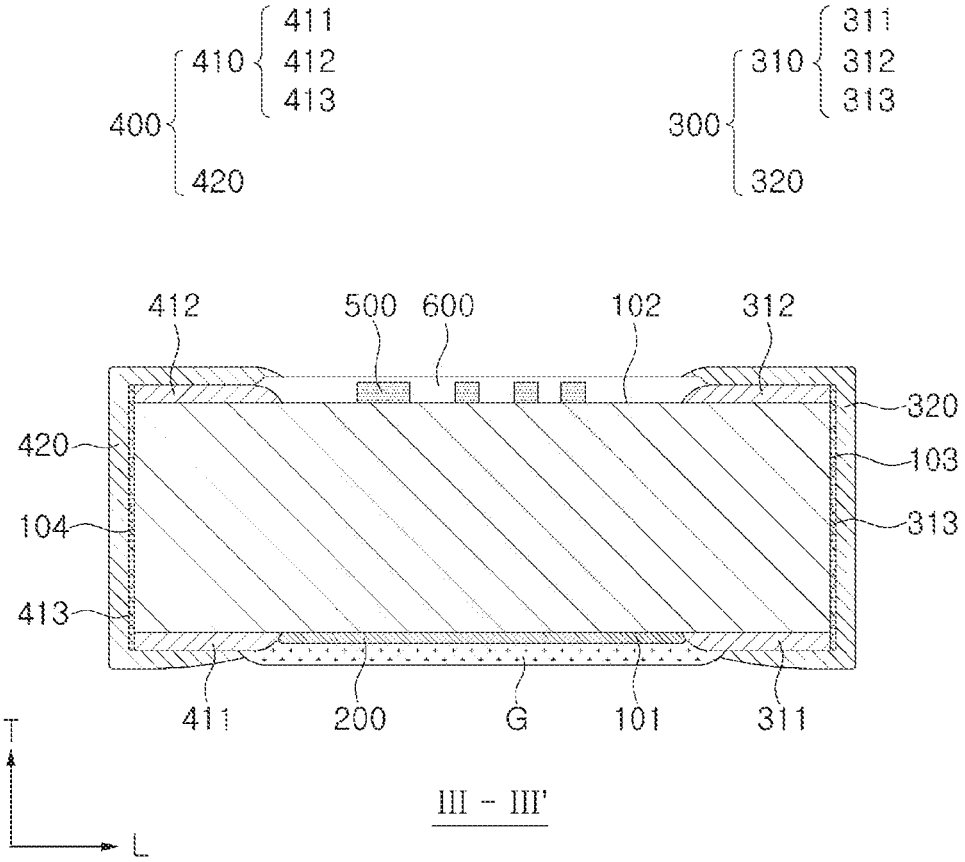
FIG. 7 is a schematic diagram illustrating a cross-section taken along line III-III' of FIG. 6.

FIG. 1 is a schematic diagram illustrating a resistor component according to an exemplary embodiment of the present disclosure, and FIG. 2 is a top view schematically illustrating FIG. 1 while FIG. 3 is a schematic diagram illustrating a cross-section taken along line I-I' of FIG. 1. FIG. 4 is a diagram schematically illustrating a modified example of a resistor component according to an exemplary embodiment and corresponding to FIG. 2, and FIG. 5 is a schematic diagram illustrating a cross-section taken along line II-II' of FIG. 4. FIG. 6 is a diagram schematically illustrating another modified example of a resistor component according to an exemplary embodiment and corresponding to FIG. 2, and FIG. 7 is a schematic diagram illustrating a cross-section taken along line III-III' of FIG. 6.

Based on FIGS. 1 to 7, a resistor component 1000 according to an exemplary embodiment includes an insulating substrate 100, a resistance layer 200, first and second terminals 300 and 400, a marking pattern portion 500 and a marking protection layer 600 and may further include a resistance protective layer G.

Based on FIGS. 1 and 3, the insulating substrate 100 includes a first surface 101 and a second surface 102 opposing each other in a thickness direction (e.g., T direction), and a third surface 103 and a fourth surface 104 in a length direction (e.g., L direction).

The insulating substrate 100 may be provided in the form of a plate having a predetermined thickness and may contain a material capable of effectively dissipating heat generated in the resistance layer 200. The insulating substrate 100 may contain a ceramic material such as alumina ($Al_2O_3$), but is not limited thereto. The insulating substrate 100 may contain a polymer insulating material. In the present exemplary embodiment, the insulating substrate 100 may be an alumina insulating substrate obtained by anodizing a surface of aluminum.

The resistance layer 200 is disposed on the first surface 101 of the insulating substrate 100. The resistance layer 200 is connected to first and second terminals 300 and 400 disposed at both ends of the insulating substrate 100 in the length direction L to function as the resistor component 1000. The resistance layer 200 may have a region overlapping with the first and second terminals 300 and 400.

The resistance layer 200 may contain a metal, a metal alloy, a metal oxide, or the like. As an example, the resistance layer 200 may contain at least one of a Cu—Ni based alloy, a Ni—Cu based alloy, a Ru oxide, a Si oxide and a Mn based alloy. The resistance layer 200 may be formed by applying a paste for forming a resistance layer, in which a metal, a metal alloy, a metal oxide, or the like, is contained on the first surface 101 of the insulating substrate 100, by a screen-printing method, or the like, and sintering the same.

The first and second terminals 300 and 400 may be disposed on the insulating substrate 100 to oppose each other in the L direction. Each of the first and second terminals 300 and 400 is connected to the resistance layer 200.

The first and second terminals 300 and 400 include internal electrode layers 310 and 410 having one-surface electrodes 311 and 411 disposed on the first surface 101 of the insulating substrate 100, opposite-surface electrodes 312 and 412 disposed on the second surface 102 of the insulating substrate 100, and side-surface electrodes 313 and 413 disposed on both side surfaces 103 and 104 and connecting the one-surface electrodes 311 and 411 and the opposite-surface electrodes 312 and 412, and external electrode layers 320 and 420 formed on the internal electrode layers 310 and 410.

Specifically, the first terminal 300 includes an internal electrode layer 310 having a first one-surface electrode 311 disposed on the first surface 101 of the insulating substrate 100, a first opposite-surface electrode 312 disposed on the second surface 102 of the insulating substrate 100, and a first side-surface electrode 313 disposed on the third surface 103 of the insulating substrate 100. Further, the first terminal 300 includes a first external electrode layer 320 covering the first internal electrode layer 310. The second terminal 400 includes a second internal electrode layer 410 having a second one-surface electrode 411 disposed on the first surface 101 of the insulating substrate 100, a second opposite-surface electrode 412 disposed on the second surface 102 of the insulating substrate 100, and a second side-surface electrode 413 disposed on the fourth surface 104 of the insulating substrate 100. Further, the second terminal 400 includes a second external electrode layer 420 covering the second internal electrode layer 410.

The one-surface electrodes 311 and 411 and the opposite-surface electrodes 312 and 412 may be formed by applying a conductive paste on the first surface 101 and the second surface 102 followed by sintering the same. The conductive paste for forming the one-surface electrodes 311 and 411 and the opposite-surface electrodes 312 and 412 may contain a powder of a metal, such as copper (Cu), silver (Ag), nickel (Ni), or the like, a binder and a glass. Thicknesses of the surface electrodes 311 and 411 and the opposite-surface electrodes 312 and 412 may be 3 μm to 6 μm, but are not limited thereto.

The side surface electrodes 313 and 413 may be formed by vapor deposition, such as sputtering, on the third surface 103 and the fourth surface 104. The side surface electrodes 313 and 413 may be a metal layer containing at least one of Ni, titanium (Ti), chromium (Cr), molybdenum (Mo) and alloys thereof. The side surface electrodes 313 and 413 may have a thickness of 0.07 μm to 0.15 μm, but are not limited thereto.

The external electrode layers 320 and 420 may be a deposition layer formed by electroplating. The external electrode layers 320 and 420 may contain at least one of Cu, Ni and tin (Sn). The external electrode layers 320 and 420 may include a plurality of plating layers. For example, each of the external electrode layers 320 and 420 may have a structure in which a Cu-plating layer, a Ni-plating layer and a Sn-plating layer are sequentially formed.

The marking pattern portion 500 is to deliver information of a mounting direction, resistance, or the like, of the resistor component 1000 and is disposed on the second surface 102 of the insulating substrate 100. The marking pattern portion 500 may be disposed on the second surface 102 of the insulating substrate 100 by a combination of letters, numbers, and figures. For example, as illustrated in FIG. 2, the marking pattern portion 500 may be patterned in the form of "ABC" on the second surface 102 of the insulating substrate 100. The marking pattern portion 500 may be formed by printing a paste for forming a marking pattern portion on the second surface 102 of the insulating substrate 100 and curing or sintering the paste, but is not limited thereto. The paste for forming a marking pattern portion may contain a curable insulating resin, such as an epoxy resin, and a colorant for identifying a marking pattern portion 500.

A marking portion of a resistor component may be damaged during processes subsequent to formation thereof. As an example, when a terminal is formed by plating after the marking portion is formed, a pickling solution used in a pickling process and/or a plating solution used in a plating process, which is a pretreatment process of the plating process, may penetrate between the marking portion and the insulating substrate, and the marking portion may be detached from the insulating substrate due to thermal or physical impacts in the plating and pretreatment processes.

In the case of the present disclosure, once the marking pattern portion 500 is formed on the second surface 102 of the insulating substrate 100, a marking protection layer 600 is additionally formed on the second surface 102 of the insulating substrate 100 for protecting the marking pattern portion 500. The marking protection layer 600 reduces external impacts applied to the marking pattern portion 500 during the subsequent processes and also reduces the solutions used in the subsequent processes penetrating between the marking portion 500 and the second surface 102 of the insulating substrate 100.

A thickness of the marking protection layer 600 may be 5 μm to 20 μm. When the thickness is less than 5 μm, it is difficult to form the marking protection layer 600 by the printing method. When the thickness exceeds 20 μm, transmittance of the marking protection layer 600 decreases, thereby making it difficult to recognize the marking pattern portion 500 covered by the marking protection layer 600. In one example, the thickness of the marking protection layer 600 may refer to a shortest distance from a major uppermost surface of the marking protection layer 600 to the second surface 102 of the insulating substrate 100.

The marking protection layer 600 may contain a curable insulating resin, such as an epoxy resin. When the insulating resin of the marking protection layer 600 and the insulating resin of the marking pattern portion 500 are the same insulating resin, bonding force therebetween may be improved.

The marking protection layer 600 may further contain an insulating filler. The insulating filler may improve mechanical rigidity of the marking protection layer 600. The insulating filler may be an organic filler and/or an inorganic filler.

The organic filler may include, for example, at least one of acrylonitrile-Butadiene-Styrene (ABS), cellulose acetate, nylon, Polymethyl methacrylate (PMMA), polybenzimidazole, polycarbonate, polyether sulfone, polyether ether ketone (PEEK), polyetherimide (PEI), polyethylene, polylactic acid, polyoxymethylene, polyphenylene oxide, polyphenylene sulfide, polypropylene, polystyrene, polyvinyl chloride, ethylene vinyl acetate, polyvinyl alcohol, polyethylene oxide, epoxy and polyimide, The inorganic filler may include at least one selected from the group consisting of silica ($SiO_2$), alumina ($Al_2O_3$), silicon carbide (SiC), titanium oxide ($TiO_2$), barium sulfate ($BaSO_4$), aluminum hydroxide ($Al(OH)_3$), magnesium hydroxide ($Mg(OH)_2$), calcium carbonate ($CaCO_3$), Magnesium carbonate ($MgCO_3$), magnesium oxide (MgO), boron nitride (BN), aluminum borate ($AlBO_3$), barium titanate ($BaTiO_3$) and calcium zirconate ($CaZrO_3$).

Based on FIGS. 2 and 3, in the present exemplary embodiment, the marking protective layer 600 may be formed in the form corresponding to the marking pattern portion 500. That is, as illustrated in FIG. 2, when the marking pattern portion 500 is patterned in the form of "ABC", the marking protection layer 600 may also be patterned in the form of "ABC." To cover the marking pattern portion 500, a line width of the marking protection layer 600 may be wider than the marking pattern portion 500. Meanwhile, as the shapes of the marking pattern portion 500 and the marking protection layer 600 are the same in the present exemplary embodiment, the transmittance of the marking protection layer 600 is not problematic. In other words, it is not problematic even when the marking protection layer 600 is formed to be relatively thick, contains a colored insulating resin, or contains a relatively excessive amount of a colored insulating filler, thereby making it difficult to recognize the marking pattern portion 500.

In one exemplary embodiment, a line width of the marking protection layer 600 may be greater than a line with of the marking pattern portion 500 in a plan view (e.g., L-W directions) of the resistor component 1000 in parallel to the second surface 102 of the insulating layer 100.

Based on FIGS. 4 and 5, in the case of a modified example, the marking protection layer 600 is formed to cover one region of the second surface 102 of the insulating substrate 100 on which the marking pattern portion 500 is formed. Specifically, based on FIG. 4, the marking protection layer 600, while being formed on the second surface 102 of the insulating substrate 100 to cover the marking pattern portion 500, is spaced apart from both ends of the second surface 102 of the insulating substrate in the width direction and from the first and second terminals 300 and 400. In one exemplary embodiment, the marking protection layer 600 may be in contact with a portion of the second surface 102 of the insulating substrate 100.

Based on FIGS. 6 and 7, in another modified example, the marking protection layer 600 covers the second surface 102 of the insulating substrate 100 excluding the region in which the marking pattern portion 500 and the opposite-surface electrodes 312 and 412 are formed. In other words, the marking protection layer 600 may entirely cover the second surface 102 of the insulating substrate 100 between the first and second terminals 300 and 400. In one exemplary embodiment, an outermost edge of the marking protection layer 600 may be in contact with the first and second terminals 300 and 400.

In the cases of the one modified example and the another modified example, the marking protection layer 600 may have at least 70 transmittance to easily externally recognize the marking pattern portion 500. The marking protection layer 600 may contain the insulating filler in an amount of 5 wt % or less. Further, in this case, to secure transparency of the marking protection layer 600, the marking protection layer 600 may contain a white-based insulating filler.

The resistance protective layer G may be disposed on the first surface 101 of the insulating substrate to cover a surface of the resistance layer 200 on which the first and second terminals 300 and 400 are not disposed. Although not limited, the resistance protective layer G may contain silicon ($SiO_2$), a glass, and/or a polymer.

The resistance protective layer G may include a first protective layer formed by applying a paste containing a glass to the first surface 101 of the insulating substrate 100 and sintering the same to cover the resistance layer 200 and a second protective layer formed by applying a paste containing a curable resin to the first protective layer and curing the same, but is not limited thereto.

As set forth above, according to the present disclosure, a defect, such as a damage on a marking pattern portion, can be reduced.

While exemplary embodiments have been shown and described above, it will be apparent to those skilled in the art that modifications and variations could be made without departing from the scope of the present invention as defined by the appended claims.

What is claimed is:

1. A resistor component, comprising:

an insulating substrate;

a resistance layer disposed on a first surface of the insulating substrate; and first and second terminals, spaced apart from each other, respectively disposed on external surfaces of the insulating substrate and connected to the resistance layer;

a marking pattern portion comprising a material disposed on a second surface of the insulating substrate, opposing the first surface of the insulating substrate, such that the resistance layer is not interposed between the marking pattern portion and the insulating substrate in a thickness direction; and a marking protection layer disposed on the second surface of the insulating substrate and covering the marking pattern portion.

2. The resistor component of claim 1, wherein the marking protection layer is disposed on the marking pattern portion in a shape corresponding to the marking pattern portion.

3. The resistor component of claim 2, wherein a line width of the marking protection layer is greater than a line with of the marking pattern portion in a plan view of the resistor component in parallel to the second surface of the insulating substrate.

4. The resistor component of claim 1, wherein the marking protection layer covers a portion of the second surface of the insulating substrate on which the marking pattern portion is disposed.

5. The resistor component of claim 1, wherein the marking protection layer has transmittance of 70% or above.

6. The resistor component of claim 1, wherein each of the marking pattern portion and the marking protection layer comprises a curable insulating resin.

7. The resistor component of claim 6, wherein the insulating resin is an epoxy resin.

8. The resistor component of claim 6, wherein the marking protection layer further comprises an insulating filler.

9. The resistor component of claim 8, wherein the insulating filler is contained in the marking protection layer in an amount of 5 wt % or less and greater than 0 wt %.

10. The resistor component of claim 1, wherein each of the first and second terminals comprises:

a one-surface electrode disposed on the first surface of the insulating substrate and in contact with the resistance layer resistance layer;

an opposite-surface electrode disposed on the second surface of the insulating substrate; and a side-surface electrode disposed on a side surface connecting the first surface and the second surface of the insulating substrate and connecting the one-surface electrode and the opposite-surface electrode.

11. The resistor component of claim 10, wherein each of the first and second terminals further comprises an external electrode layer disposed on the one-surface electrode, the opposite-surface electrode and the side-surface electrode.

12. The resistor component of claim 1, further comprising a resistance protection layer disposed on the first surface of the insulating substrate and covering the resistance layer.

13. The resistor component of claim 1, wherein the marking protection layer is in contact with a portion of the second surface of the insulating substrate.

14. The resistor component of claim 1, wherein the marking protection layer entirely covers the second surface of the insulating substrate between the first and second terminals.

15. The resistor component of claim 1, wherein an outermost edge of the marking protection layer is separate from the first and second terminals.

16. The resistor component of claim 1, wherein an outermost edge of the marking protection layer is in contact with the first and second terminals.

17. The resistor component of claim 1, wherein a thickness of the marking protection layer is within a range of 5 μm to 20 μm.

18. The resistor component of claim 1, wherein the first and second surfaces of the insulating substrate are flat.

19. The resistor component of claim 1, wherein the marking pattern portion is electrically isolated from the first and second terminals.

20. The resistor component of claim 1, wherein the insulating substrate includes third and fourth surfaces opposing each other in a width direction, and the third and fourth surfaces are devoid of the resistance layer and marking pattern portion.

* * * * *